US007703539B2

(12) United States Patent
Levy

(10) Patent No.: US 7,703,539 B2
(45) Date of Patent: Apr. 27, 2010

(54) EXPANDABLE DOWNHOLE TOOLS AND METHODS OF USING AND MANUFACTURING SAME

(76) Inventor: Warren Michael Levy, Uruguay 1240 "4A", Buenos Aires (AR) C1016ACF ( * ) Notice: Subject to any disclaimer, the term of this patent is extended or adjusted under 35 U.S.C. 154(b) by 384 days.

(21) Appl. No.: 11/689,427

(22) Filed: Mar. 21, 2007

(65) Prior Publication Data

US 2007/0221387 A1 Sep. 27, 2007

Related U.S. Application Data

(60) Provisional application No. 60/784,556, filed on Mar. 21, 2006.

(51) Int. Cl.
*E21B 33/12* (2006.01)

(52) U.S. Cl. ..... 166/378; 166/387; 166/118

(58) Field of Classification Search ..... 166/179, 166/118, 380, 378, 387; 277/331, 332, 334, 277/333

See application file for complete search history.

(56) References Cited

U.S. PATENT DOCUMENTS

| | | | | |
|---|---|---|---|---|
| 2,849,070 | A | 8/1958 | Maly | |
| 3,385,367 | A | 5/1968 | Kollsman | |
| 3,611,733 | A * | 10/1971 | Ellers | 405/264 |
| 4,137,970 | A | 2/1979 | Laflin et al. | |
| 4,730,670 | A | 3/1988 | Kim | |
| 4,768,590 | A | 9/1988 | Sanford et al. | |
| 4,923,007 | A | 5/1990 | Sanford et al. | |
| 5,195,583 | A | 3/1993 | Toon et al. | |
| 5,711,372 | A | 1/1998 | Stokley | |
| 5,941,313 | A | 8/1999 | Arizmendi | |
| 6,508,305 | B1 | 1/2003 | Brannon et al. | |
| 6,752,205 | B2 | 6/2004 | Kutac et al. | |
| 6,907,937 | B2 | 6/2005 | Whanger et al. | |
| 6,935,432 | B2 | 8/2005 | Nguyen | |
| 6,962,206 | B2 | 11/2005 | Hirth et al. | |
| 7,143,832 | B2 | 12/2006 | Freyer | |
| 7,284,619 | B2 | 10/2007 | Stokley et al. | |

(Continued)

FOREIGN PATENT DOCUMENTS

| | | |
|---|---|---|
| EP | 1672166 | 6/2006 |

(Continued)

OTHER PUBLICATIONS

International Search Report, PCT/IB2007/000929, dated Oct. 4, 2007.

*Primary Examiner*—Jennifer H Gay
*Assistant Examiner*—David Andrews
(74) *Attorney, Agent, or Firm*—Holme Roberts & Owen LLP

(57) ABSTRACT

An expandable downhole tool is disclosed that employs naturally occurring organic matter as the expandable material. The expandable material is located within an enclosure formed in part by an impermeable element, which may form a hydraulic seal, and a permeable membrane that permits fluids present in the wellbore to pass and interact with the organic matter. The heat and fluids present within the wellbore may cause the expandable matter to swell, and thus causing the enclosure to swell and possibly form a hydraulic seal against a wellbore or inner annulus. The expandable tool may be used as packer, plug, or other downhole tool, among others. Methods of manufacturing and using such tools are also disclosed.

29 Claims, 4 Drawing Sheets

U.S. PATENT DOCUMENTS

| | | | | |
|---|---|---|---|---|
| 7,296,597 | B1 | 11/2007 | Freyer et al. | |
| 2004/0020662 | A1* | 2/2004 | Freyer | 166/387 |
| 2004/0194971 | A1* | 10/2004 | Thomson | 166/387 |
| 2005/0199401 | A1 | 9/2005 | Patel et al. | |
| 2005/0205266 | A1 | 9/2005 | Todd et al. | |
| 2007/0012436 | A1 | 1/2007 | Freyer | |
| 2007/0227734 | A1 | 10/2007 | Freyer | |
| 2007/0246225 | A1 | 10/2007 | Hailey, Jr. et al. | |
| 2007/0257405 | A1 | 11/2007 | Freyer | |

FOREIGN PATENT DOCUMENTS

| | | |
|---|---|---|
| JP | 9151686 | 6/1997 |
| WO | 2006009863 | 9/2006 |
| WO | 2006118470 | 11/2006 |
| WO | 2007031723 | 3/2007 |

* cited by examiner

EXPANDABLE DOWNHOLE TOOLS AND METHODS OF USING AND MANUFACTURING SAME

PREVIOUS APPLICATION DATA

This application claims the benefit of U.S. Provisional Patent Application No. 60/784,556 filed on Mar. 21, 2006.

BACKGROUND OF THE INVENTION

1. Field of the Invention

The present invention relates to packers, packing elements, and other downhole tools that employ an expandable element to isolate various sections of a well bore drilled in the earth from other sections of the well bore. In particular, a packer may include naturally occurring organic matter that may expand when exposed to the heat or liquids present in a wellbore. Methods of using and manufacturing such tools are also disclosed.

2. State of the Art

During the process of drilling a well, the well bore typically encounters a variety of rock formations, or stratigraphic layers. These stratigraphic layers typically include different constituent components such as minerals and fluids, including gases and liquids, of varying types. The different gases and liquids, however, typically segregate by density, with the least dense fluids (including gases) located higher within a particular rock formation. Typically, it is desirable to keep the different fluids present in a given stratigraphic layer physically separate while pumping from the well. Additionally, it is typically desirable to keep fluids and gases present in a first stratigraphic layer physically separate from the gases and fluids that are present in a second stratigraphic layer.

For example, FIG. 4 illustrates a two dimensional view of a first formation 405 that includes water, a second formation 410 that is an impermeable formation, such as shale, and a third formation 415 that includes hydrocarbons that are encountered by a well bore 425. The first formation 405 is at a relatively lower hydrostatic pressure as compared to the hydrostatic pressure present in the third, deeper formation 415, the second, impermeable formation 410 preventing the less dense (as compared to water) hydrocarbons present in the third formation 415 from migrating upwards into the first formation 405. If the formations 405 and 415 are not physically isolated from each other in some manner, whether by the formation 410 initially or a packer 10, and a path, such as a well bore 425, exists along which formation fluids 420 can flow, the fluids 420 at the higher hydrostatic pressure in the third formation 415 would flow from the third formation 415 into the lower pressure first formation 405, thereby contaminating the water present in the first formation 405. To prevent this, production tubing 430 is connected to a packer 10 that is positioned at a depth above or within the third formation 415. An impermeable element 22 provides a hydraulic seal against the formation 415, preventing formation fluids 420 present in the formation 415 from flowing around the packer and into the first formation 405 at the lower hydrostatic pressure. Instead, the formation fluids 420 flow through a conduit 21 (seen in FIGS. 2-3) of the packer 10 and into the production tubing 430 and onto the surface for processing.

Packers are used in a variety of applications, including wellbore stimulation and testing, protecting casing from the corrosive fluids that the well produces, holding treatment and kill fluids, and other applications known in the art. Packers typically include several components, including a sealing device, a setting or holding device, and, a conduit to permit the passage of fluids between the isolated zones in a controlled manner. The sealing element is expanded to isolate the annulus of an upper section of a well bore from a lower section. Packers are used in a variety of settings in which it is desirable to isolate different sections of the well bore from each other. These sections include, but not limited to, different sections of casing and production tubing set within the well bore, between casing and an unlined borehole, and separate sections of an unlined borehole, among others.

Packers are typically positioned in a wellbore by using a wireline, drill pipe, tubulars, or coiled tubing that is connected to the packer to deliver the packer to a desired depth in the well bore. Once the packer reaches a desired depth, one of a variety of mechanisms known in the art is employed to set the packer, which involves expanding a sealing element until it contacts the side of the well bore or casing, thereby isolating the section of well bore or casing above the sealing element from the section below the sealing element. A typical sealing element of a packer includes an elastomeric element located between upper and lower retaining rings, with the sealing element compressed to radially expand outwardly until it contacts the casing or borehole wall. Another common design for a sealing element is to pump a fluid, such as a gas or a liquid, into a bladder located within an elastomeric element, the fluid causing the elastomeric element to expand. Yet another known method employs elastomers that swell in the presence of hydrocarbons to create a seal.

Several shortcomings exist, however, in existing packers. Most of the methods of setting and expanding packers require the intervention of an operator at the surface, which increases the complexity of the setting operation. Further, packers that rely on mechanical or hydraulic interventions increase the risk of mechanical or hydraulic failure of the packer, both at the surface and downhole, as well as increasing the time and the cost of using the packer. In addition, the elastomers used in many packers are susceptible to corrosion and deterioration when exposed to the heat and fluids present in a wellbore, which may lead to a loss of an effective hydraulic seal, which could require a costly intervention or work-over to remedy.

Therefore, it is desirable to have a packer that operates with a minimal amount of intervention once it is positioned in the well.

BRIEF SUMMARY OF THE INVENTION

The present invention includes a packer that requires minimal intervention, as well as methods for manufacturing and using the same. Throughout this application the term "packer" is used merely for convenience, but the disclosure applies equally to plugs and other tools that employ an expandable element in the wellbore.

The packer includes an expansion material, a permeable membrane, and an impermeable element. The permeable membrane and the impermeable element form an enclosure that holds the expansion material. Heat and fluids, in particular, liquids, present in a wellbore cross the permeable membrane and interact with the expansion material and causes the expansion material to increase in volume. As the expansion material increases in volume, it causes the enclosure to expand until the permeable membrane and the impermeable element presses against a well bore or an inner annulus of a casing or production tubing or other pipe. The impermeable element forms a hydraulic seal against the well bore or inner annulus and hydraulically isolates a section or segment of the borehole or inner annulus above the packer from a segment or section below the packer. In this application, while specific reference is made to a hydraulic seal against a well bore and an inner annulus, it will be understood that a reference to one includes reference to the other. Optionally, the packer includes a conduit that permits fluids, such as water, oil, or gas, to pass from a lower side of the packer to an upper side of the packer in a controlled manner.

The expansion material is a naturally occurring organic matter that includes all or part of a variety of plants, plant products, and plant derivatives, as will be discussed more fully below. Optionally, the naturally occurring organic matter is coated with a soluble coating to control the rate at which the expansion material is exposed to fluids that cross the permeable membrane. Yet another option is to form a mixture of the organic matter and a soluble component, such as one soluble in water, like gelatin, to form a matrix of the organic matter and the soluble component in addition to or in lieu of coating each individual piece of organic matter. As the soluble component dissolves into solution with the fluids present in the well bore, an increasing volume of the organic matter is exposed to the heat and fluids, causing the organic matter to swell. A further benefit of using naturally occurring organic matter as an expansion material is that the packer can be field serviceable, as it does not contain the complex mechanical components that conventional packers typically contain, further reducing the costs associated with using the packer.

The permeable membrane, which forms part of an enclosure, permits the passage of heat and fluids and, in particular, liquids present in the well bore (in situ fluids) to the expansion material through a plurality of pores and is formed, in part, from rubber, elastomers, and other materials resistant to degradation when exposed to hydrocarbons and other fluids present in the well bore. The permeable membrane attaches to a pipe or tube that is connected to a means of conveying the packer to a desired depth in a wellbore or annulus. The permeable membrane is also connected or attached to the impermeable membrane to form part of the enclosure in which the expansion material is held. The rate that the expansion material increases in volume is metered, in part, by controlling the rate at which the expansion material is exposed to the fluids present in the well bore in a given period of time. For example, the rate that the expansion material increases in volume is controllable by varying the number of pores and the size of the pores in the permeable membrane, thereby controlling the amount of fluid that crosses the permeable membrane in a given period of time.

Methods of using embodiments of the invention are also disclosed. A packer is connected through a means of conveying the packer to a desired depth through the use of drill pipe, tubulars, coiled tubing, wireline, and other conveyance methods known in the art. The fluids and the heat present in the wellbore cross the permeable membrane and interact with the expansion material, which causes the expansion material to increase in volume or swell. Such a swelling of the expansion material causes the enclosure to swell or expand, allowing the impermeable membrane to contact an inner annulus of a pipe, tubular, or the exposed wall of the well bore and conform to the surface, thus creating a hydraulic seal between the impermeable membrane and the inner annulus of a pipe, tubular, or the exposed wellbore.

Methods of manufacturing packers are also disclosed.

Other features and advantages of the present invention will become apparent to those of ordinary skill in the art through consideration of the ensuing description, the accompanying drawings, and the appended claims.

DETAILED DESCRIPTION

Figure 1:
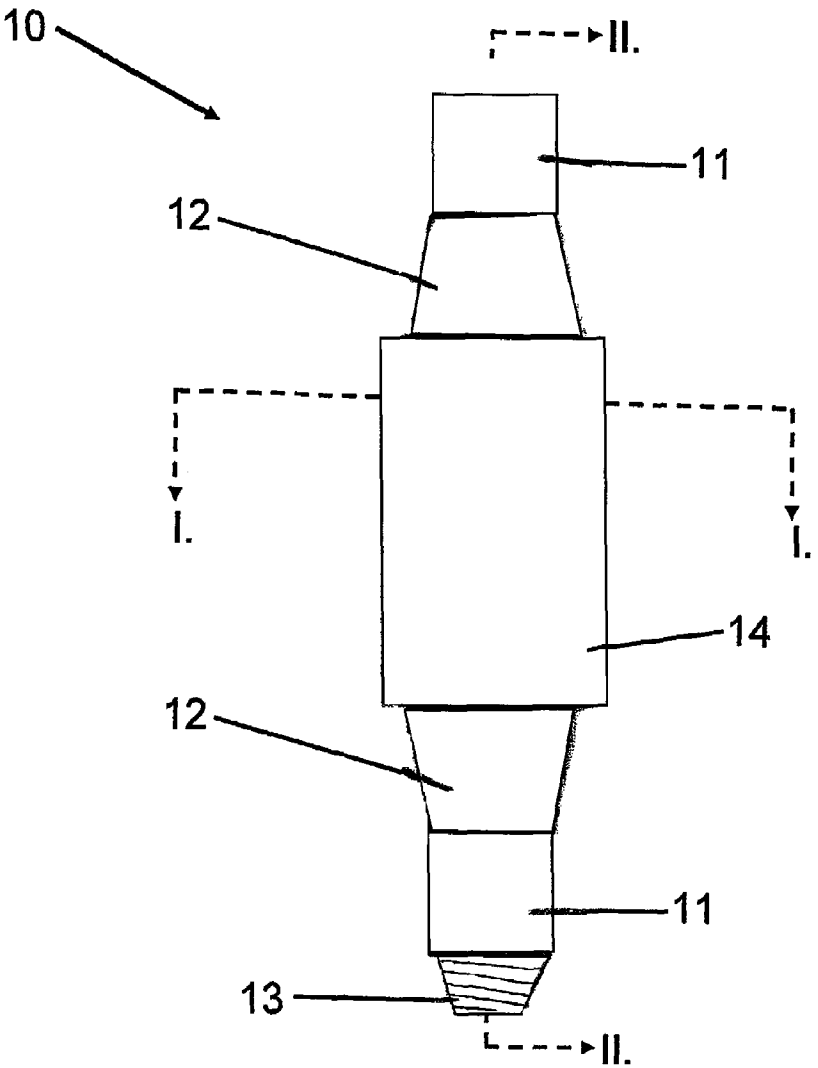
FIG. 1 is a side view of an example of a pipe-conveyed packer.
Figure 2:
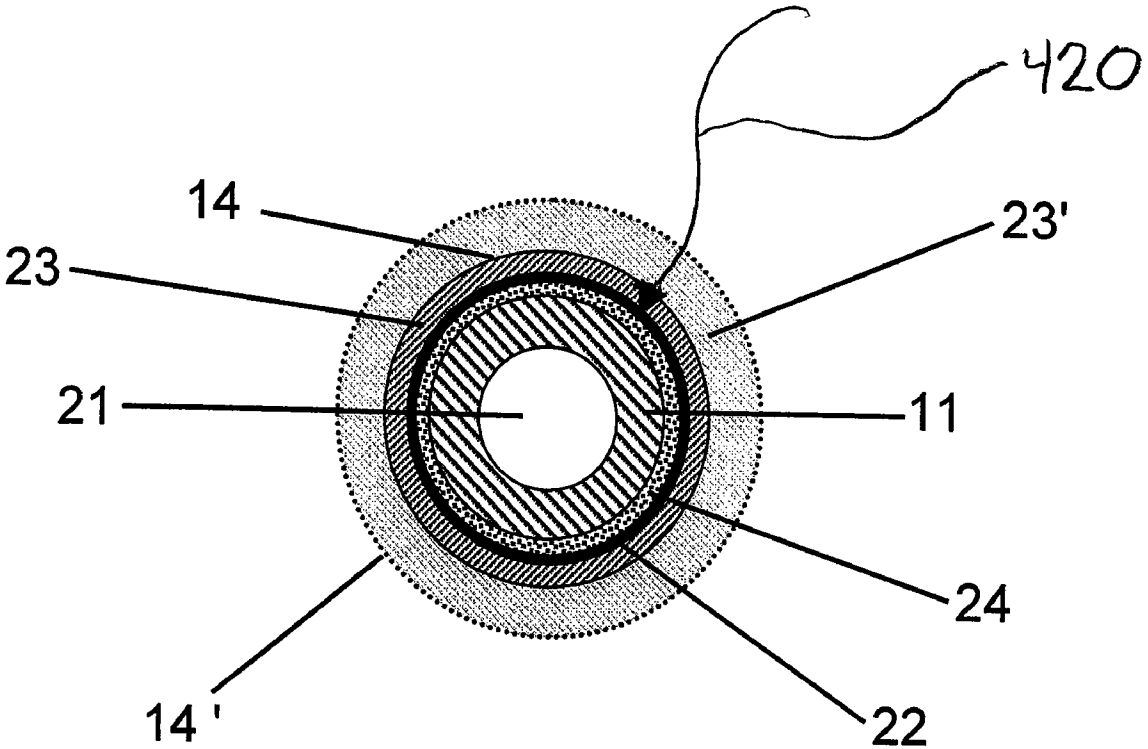
FIG. 2 is a cross-section taken along line 1.-I. of the pipe-conveyed packer of FIG. 1, indicating unexpanded and expanded profiles of the packer.
Figure 3:
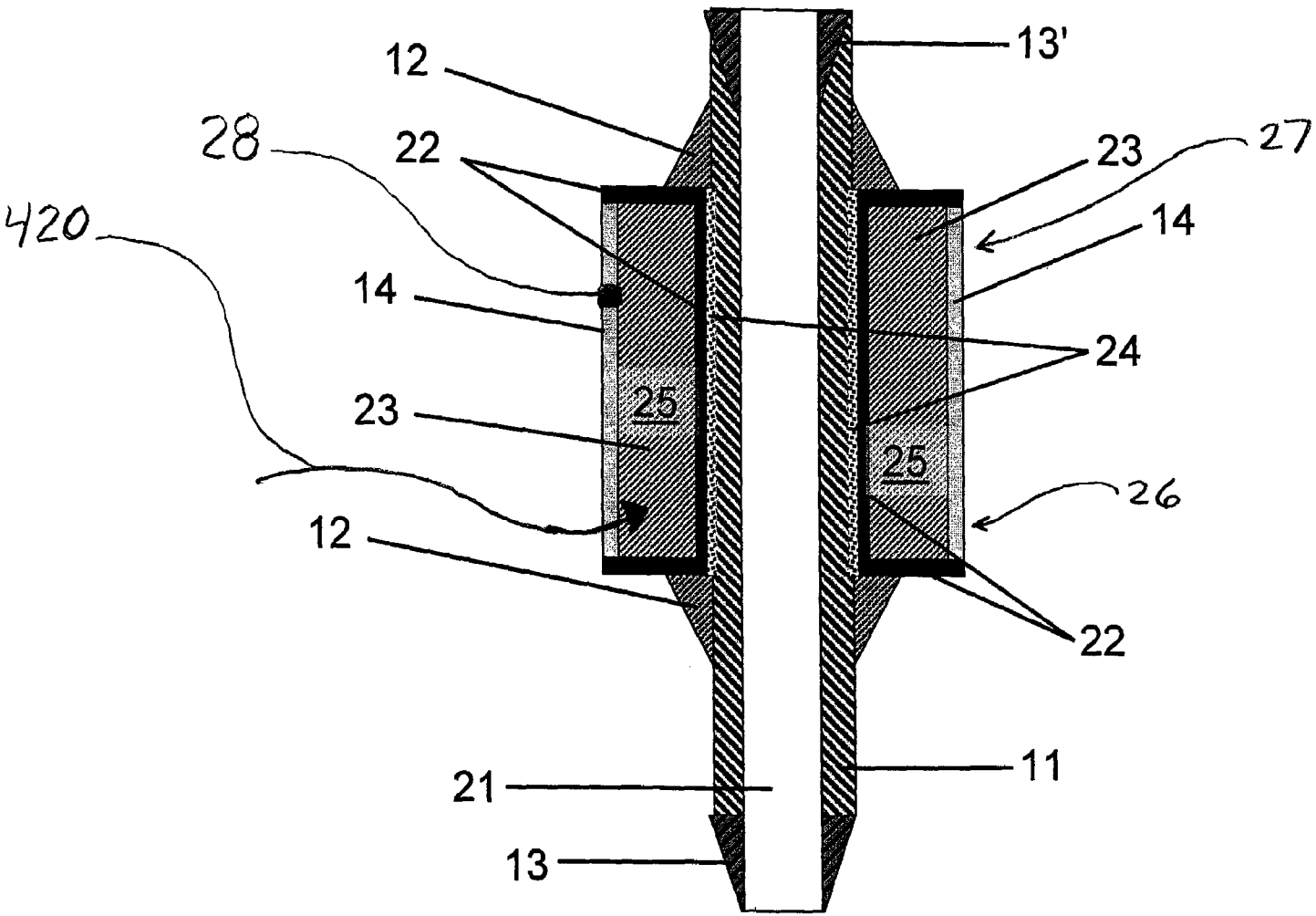
FIG. 3 is a cross-section taken along line 11.-I1. of the pipe-conveyed packer of FIG. 1; and, FIG. 4 is a two-dimensional view of a packer disposed in well bore.
Figure 4:
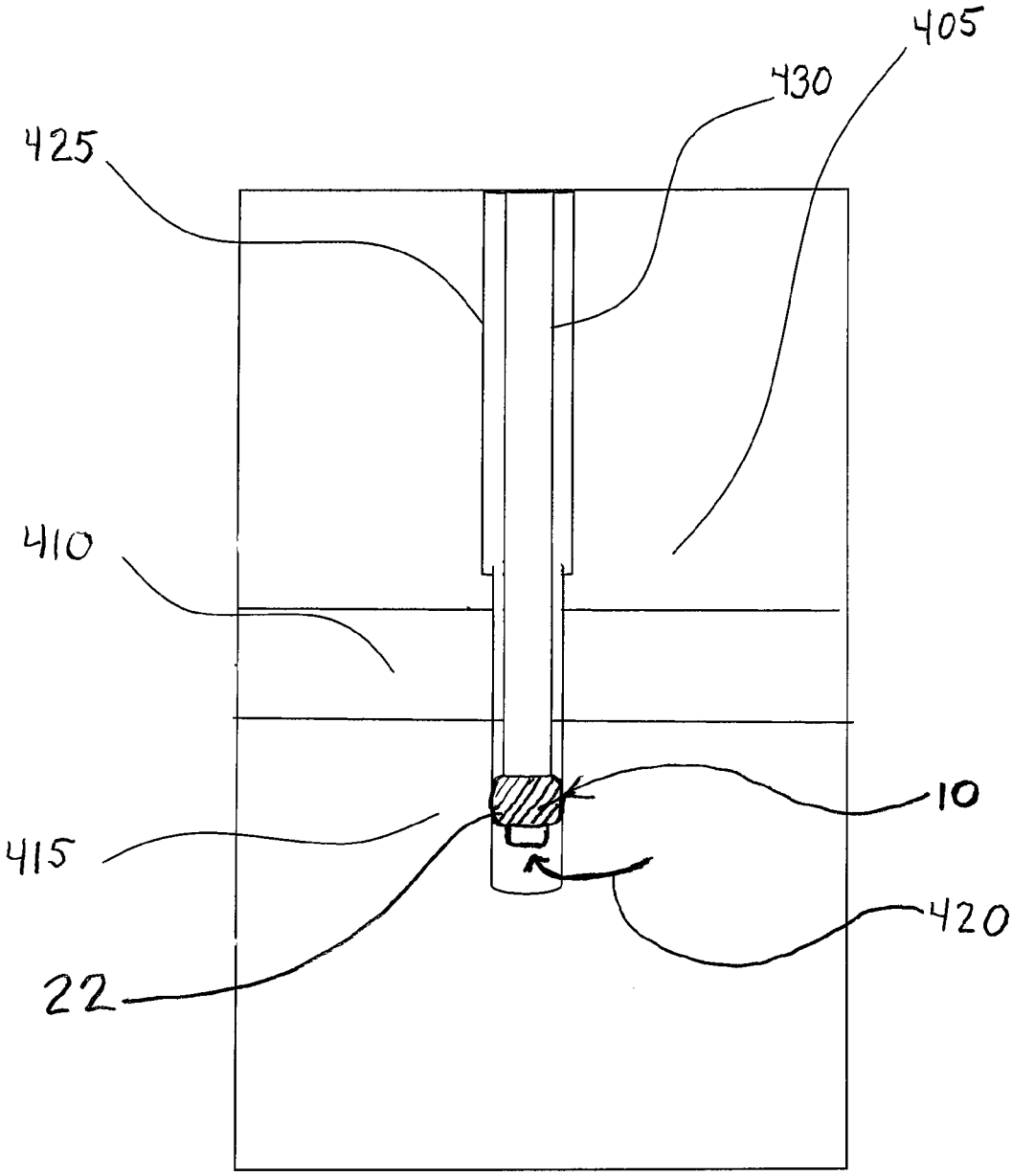

An embodiment of the present invention, a pipe- or tubular-conveyed packer 10, is illustrated in FIGS. 1-3. The packer 10 includes a base pipe or tubular 11, a locking collar or clamp 12, a connection 13, and a permeable membrane 14.

The base pipe 11 is manufactured from drilling pipe, coiled tubing, production tubing, and any other similar tubing known in the art. The base pipe 11, when the packer 10 is to be pipe-conveyed, includes a connection 13, various types of which include a pin connection 13 and a box connection, 13', visible in FIG. 3 for connecting the packer 10 to a means of conveying the packer, such as drill pipe. Typically, the pin and box connections have American Petroleum Institute (API) threaded tool joints, which are a common standard across the oilfield, although other thread types fall within the scope of the invention. In addition, while shown in the standard oilfield "box up/pin down" set up, other connection configurations are contemplated, including a "box-box" connection, "pin-pin" connection, and other connection configurations. Rather than pipe- or tubular-conveyed, other means or techniques to convey the packer 10 to desired depth or position in a well bore can be used. Such means include coiled-tubing or wireline, among others. In such instances, the base pipe 11 of the packer 10 connects to a coiled-tubing or wireline system through an appropriate connection for the respective means as is known in the art rather than the threaded pipe connection 13, 13' described herein. Returning to FIG. 3, the base pipe or tubular 11 optionally has an inner annulus 21 that permits fluids, including those fluids present in the well bore, production fluids, and treatment fluids, to flow from one side of the packer 10 to the other. However, if the packer 10 is intended to be used as a plug or if it is otherwise undesirable to have fluids communicate across the hydraulic seal the packer 10, the pipe or tubular 11 does not include an inner annulus 21.

FIG. 2 is a cross-section taken though the line I.-I. of packer 10 in FIG. 1. The base pipe or tubular 11 has an inner annulus 21 through which fluids may flow from one side of the packer to the other. This is a typical configuration when the packer 10 is used as part of a completion assembly, i.e., an assembly that is used to produce fluids from a well bore, although, as mentioned, the packers embodied herein are used in other applications. As an example, if the packer 10 is used in a completion assembly, fluids from a formation or zone bearing hydrocarbons flow up through the inner annulus 21 of the base pipe or tubular 11 and into production tubing connected to the connection 13', while the impermeable element 22 forms a hydraulic seal against the wall of the well bore or casing that prevents the produced hydrocarbons from flowing around the packer 10.

In FIG. 3, an impermeable element 22 is formed from an elastomer, rubber, and other materials that are impermeable to one or more fluids present in a well bore. Regardless of the type of material from which the impermeable element 22 is made, the material of impermeable element 22 is selected from those materials that meet requirements such as: chemical resistance to degradation and interaction with the fluids present in the well bore and production/completion fluids that are added to the well as part of the production process; stability, i.e., minimal or no degradation in the material and its physical properties, such as elasticity, under a range of temperatures; resilience; firmness; and other characteristics, with no or minimal degradation in performance. The impermeable element 22 is bonded to the base pipe or tubular 11 through the use of a bonding agent 24, adhesive, or glue. Optionally, a locking collar 12, or clamp, is used in lieu of or as a supplement to the bonding agent 24. Another method of attaching the impermeable element 22 to the base pipe or tubular 11 includes using a groove located in the base pipe or tubular 11 to form a mechanical, locking interface between the impermeable element 22 and the base pipe or tubular 11. The impermeable element 22 forms a hydraulic seal against the vertical surface of the base pipe or tubular 11, as well as between a formation layer or an inner annulus of casing or tubing in the well bore. The impermeable membrane 22 also forms part of the enclosure 25 that holds or stores the expandable material 23, thus the size, i.e., a length and a width of the impermeable membrane 22 is selected to form an enclosure 25 of a selected size capable of holding a selected volume of expansion material 23, as described below. The impermeable element 22 has an elasticity that permits the impermeable element 22 to stretch and expand in an elastic manner as the expandable material 23 held within the enclosure 25 increases in volume as the expandable material 23 interacts with the fluids and heat that pass through the permeable membrane 14. Also, the bonding agent 24 has a sufficient elasticity such that the bonding agent 24 is prevented from detaching from either the impermeable element 22 or the base pipe or tubular 11 as the impermeable element 22 stretches, which otherwise could lead to the impermeable element 22 becoming detached from the base pipe 11 as the impermeable element 22 expands.

A permeable membrane 14 forms part of the enclosure 25 that holds the expandable material 23, as seen in FIG. 3, the size, i.e., a length and a width of the permeable membrane 14 is selected to form, in part, the enclosure 25 of a selected size so that the enclosure 25 is capable of holding a preselected volume of expansion material 23. The permeable membrane can be manufactured from an elastomer, rubber, gore-tex, and other similar materials. Optionally, the permeable membrane 14 is made with the same material as the impermeable element 23, the difference lying only in that the permeable membrane 14 has a plurality of perforations or pores therein, as described below. If the permeable membrane 14 is formed of the same material as the impermeable element 23, the permeable membrane 14 can be manufactured contiguously with the impermeable membrane 23, but with perforations in the material in those areas that correspond to the permeable element 14.

Regardless of the type of material from which the permeable membrane 14 is made, the material of permeable membrane 14 is selected from those materials that meet requirements such as: chemical resistance to degradation and interaction with the fluids present in the well bore and production/completion fluids that are added to the well as part of the production process; stability, i.e., minimal or no degradation in the material and its physical properties, such as elasticity, under a range of temperatures; resilience; firmness; and other characteristics, with no or minimal degradation in performance.

The permeable membrane 14 is manufactured from a material with a plurality of pores or tiny perforations of a diameter that permits fluids to pass from the well bore into the enclosure 25 to interact with the expandable material 23. Optionally, the pores are of a diameter that only selected fluids, such as water, are capable of passing through the pore while other fluids, such as oil or other hydrocarbons, are prevented from passing through the pore. The rate at which fluids pass through the permeable membrane 14 may be controlled by adjusting the diameter of the pores, or perforations, as well as their density, or number of pores per unit area of the membrane.

The permeable membrane 14 has an elasticity that permits the permeable membrane 14 to stretch and expand as the expandable material 23 held within the enclosure 25 increases in volume as the expandable material 23 interacts with the fluids present in the well bore pass through the membrane 14. As mentioned, the expandable material 23 swells, or increases in volume, when exposed to the fluids, as the expanded material 23' indicates in FIG. 2. As the permeable membrane 14' expands, it conforms to the surface of the wellbore or casing, regardless of the conditions or the dimensions of the annulus or wellbore. As an example, rarely is an exposed wellbore perfectly round. Rather, a wellbore often suffers from what is known in the art as "rugosity," which describes the qualitative roughness of the wellbore, as well as changes in the diameter of the wellbore as the depth changes. For example, a wellbore may have a nominal diameter of 8½ inches but, in a loosely consolidated formation, the drilling fluids typically erode the wellbore to a much larger diameter that may not be perfectly round. Thus, the permeable membrane 14 and impermeable element 22 that form enclosure 25 is configured to expand and conform to a surface of unknown diameter and roughness and form an effective hydraulic seal in a variety of conditions.

As part of the enclosure 25 that holds the expandable material 23, the permeable membrane 14 is bonded with glues, adhesives, and similar bonding agents, to the impermeable element 22 after the enclosure 25 formed by the membrane 14 and the element 22 is filled with the organic matter 23. Another method of joining the impermeable element 22 with the permeable membrane 14 includes stitching the element 22 and the membrane 14 together along a seam and using a seam sealant on the stitched seam to ensure a hydraulic seal across the seam. Other methods of joining the permeable membrane 14 with the impermeable element 22 include welding, such as radio frequency and ultrasonic welding, and heat sealing treatments.

As discussed, the permeable element 14 optionally is formed from and is contiguous with the same impermeable material 22, but the permeable element 14 has small holes or perforations that permit in situ fluids, i.e., those present in a well bore, to pass into the enclosure 25 that holds the expandable material 23; in such an instance, the permeable membrane 14 is formed integrally with the impermeable element 22 with an opening for filling the enclosure 25 with the expansion material 23, the opening later being sealed through stitching, adhesives, heat sealing, radiofrequency or ultrasonic welding, and the like.

Embodiments of the expandable material 23 include naturally occurring organic material, or matter, that increases in volume from a first volume to a second, larger volume when in the presence of heat and fluids, that are present in a well bore, including water and liquid hydrocarbons, and include plants, plant products, and plant derivatives. For example, grains are just one example of a naturally occurring organic matter that falls within the scope of the invention, and include rice, wild rice, corn, oats, barleys, ryes, and other like grains. Legumes are another example of a naturally occurring organic matter that falls within the scope of the invention, including beans of many varieties, among others. Natural fibers, such as hemp, are another example of a naturally occurring organic matter. Yet another example of naturally occurring organic matter include combinations of yeast, flour of various types, sugar, and starch, among others. Regardless of type, the naturally occurring organic matter exhibits the characteristic of increasing in volume, or swelling, as it interacts with the heat and/or liquids, including water, that are present in the well bore and that cross the permeable membrane 14. For example, rice typically expands at a ratio (expanded volume:dry volume) greater than 3:1 as it interacts with heat and water, a ratio that makes it suitable as an expandable material 23 for a packer 10. Additionally, the type of expansion materials 23 is selected, in part, for a desired ratio of expansion (expanded volume:initial volume) and the rate of expansion, i.e., how quickly the expansion material 23 expands when exposed to a given temperature and type of fluid, for the conditions present in a given well.

Further, the expandable material 23 includes combinations of a variety of naturally occurring organic matter and combinations of naturally occurring organic matter, other organic matter, and inorganic matter. Fibers, both organic and inorganic, are one example of other materials with which the naturally occurring organic matter may be combined. Using a combination of materials permits the packer to be made with resources that are readily available in a given geographic region. Additionally, the use of a combination of materials permits a user to select the expansion material 23 for a desired ratio of expansion (expanded volume:initial volume) and the rate of expansion, i.e., how quickly the expansion material 23 expands when exposed to a given temperature and type of fluid, for the conditions present in a given well. Indeed, it is possible to adjust the particular combination of expansion materials 23 to more closely calibrate the desired response for the given circumstances than might otherwise be possible if a homogenous type of expansion material 23 is used. For example, the ratio of expansion and the rate of expansion for legumes typically are different than that for grains. For instance, a combination of red beans and rice in a packer can be selected as the expansion material 23 for use in a well located in Southern Louisiana, rather than an expansion material 23 of a single type of naturally occurring organic matter, because the ratio and rate of expansion of the red beans and rice correlates more closely with the conditions at a well found in South Louisiana.

Typically, the naturally occurring organic matter 23 is at least partially dried or dehydrated when the packer 10 is manufactured, which provides a more compact packer 10 arrangement and a greater ratio of expansion between the expansion material's 23 dried state and its volume after it is exposed to the fluids or heat present in the wellbore. Optionally, instead of dehydrated the expansion material 23, the expansion material 23 is dry heated, which results in the expansion material, such as rice or popcorn, puffing, or popping, into a larger volume.

Further embodiments include making a paste of the naturally occurring organic material, such as oatmeal, cornmeal, and the like, prior to manufacturing the packer 10, which further expands when exposed to the heat and fluids present in the well bore.

Regardless of the type of expansion material, heating, dehydrating, and other processing permits a measure of control over the ratio and rate at which the expansion material 23 expands, allowing the packer 10 to be adjusted to the particular conditions expected to be encountered.

Yet another possible method to control the rate at which the naturally occurring organic material expands is to coat the expansion material 23 with a soluble coating that deteriorates when exposed to the heat and/or the fluids present in the wellbore. As one example, the organic material 23 is mixed with gelatin and other similarly soluble materials prior to manufacturing the packer 10 to create a soluble coating on the organic matter. The soluble coating deteriorates as it interacts with the heat and the fluids present in the well bore, which slows the rate at which the organic matter 23 is exposed to the heat and the fluids present in the well bore, thereby slowing the rate at which the organic matter 23 expands. Rather than coating each individual grain or molecule separately, another embodiment includes forming a mixture of a soluble component and the naturally occurring organic matter 23, resulting in a matrix of organic matter 23 and a soluble component. Such a matrix typically results in a greater delay in the interaction of the organic matter 23 with the heat and fluids present in the well bore because more soluble components is present to dissolve in a matrix than is the case with a soluble coating over individual grains of organic matter 23.

Additional treatments can be applied to the organic matter 23 to enhance its use as an expandable material 23. For example, at times it is desirable to stop or limit the rate at which the organic matter 23 expands because prolonged exposure to heat and fluids present in the wellbore causes the organic matter 23 to become soft and pliable, which, under the hydrostatic pressure in the wellbore causes the organic matter 23 to eventually decrease in volume relative to its peak volume. For instance, chemical or biological agents interact with either the starch that is present in the organic matter 23 and the starch that released as the organic matter swells, causing the chemical chains in the organic matter 23 to link and harden. An example of one such biological agent is yeast, bacteria such as *e coli*, and other biological agents that feed on the sugars and starches present, which, in do so, releases carbon dioxide. The carbon dioxide further increases the expansion of the enclosure 25 holding the expandable material 23. To manage this process, the permeable membrane 14 has perforations in relatively lower area 26 of the permeable membrane 14, while an upper area 27 remains impermeable and acts as a trap for the gas produced by the biological agent. Optionally, a pressure vent or release valve 28 is included to prevent the pressure of the gas produced from the biological agent from causing a failure of the enclosure 25, which could otherwise result in a loss of the hydraulic seal against the well bore.

A method of using the packer 10 includes conveying the packer 10 to a desired depth in a wellbore through various means of conveyance, which include, among others, conveying the packer on drill pipe, tubulars, wireline, and coiled tubing that are connected to the packer 10 at the connection 13'. Liquids and heat present in the wellbore pass through the permeable membrane 14 and interact with the organic matter 23, which may cause the organic matter 23 to swell or increase in volume. If the organic matter 23 has a soluble coating or is part of a matrix of a soluble component and organic matter 23, the liquids that pass through the membrane 14 interact and dissolve the soluble coating or soluble component prior to interacting with the organic matter 23, which slows the rate at which the heat and liquids present in the wellbore interact with the organic matter 23.

The swelling of the organic matter 23 causes the impermeable element 22 and the permeable membrane 14, which form the enclosure 25, to expand elastically. The enclosure 25 continues to expand as the volume of the organic matter 23 increases until the permeable membrane 14 and the impermeable element 22 comes into contact with the well bore, the inner annulus of casing or tubing, or another mechanical barrier. The impermeable element 22 and the permeable membrane 14 conform to the surface of the well bore or the inner annulus of the casing or tubing, and the impermeable element 22 forms a hydraulic seal between the surface of the well bore or inner annulus of the casing and the impermeable element 22. Further, chemical or biological agents, such as yeast, added to the organic matter act on the organic matter 23 as it swells to harden the organic matter 23 and to prevent the organic matter 23 from becoming too soft and consequently decreasing in volume under the hydrostatic pressure of the fluids present in the well bore. If the heat present in a well is relatively low, as, for example, in the arctic or deep ocean wells, a heating element, either conveyed by wireline or integrated into the packer itself, may be used to supply additional heat, which increases the rate at which the organic matter 23 increases in volume.

Another method of modifying the environmental conditions to which the packer and the naturally occurring organic matter 23 is to pump what is known in the art as a pill into the well bore, typically through a drill pipe or production tubing and around the packer 10. A pill is a preselected volume of a liquid, or combinations of liquids, and typically includes a variety of chemicals, such as dry or liquid chemicals. The volumes and depths of various pipes, tubulars, open wellbore, and other sections are known or can be calculated, thus the pill is placed at a desired depth by pumping a preselected volume of another liquid, which, in this case, is the same depth as the packer. For example, a pill that contains a catalyst that speeds or initiates the swelling of the naturally occurring organic matter 23 is pumped to a depth around the packer. The catalyst in the pill passes through the permeable membrane 14 and interacts with the organic matter 23, increasing the rate at which the organic material 23 increases in volume as compared to the rate at which the volume of the organic matter 23 would otherwise increase if the organic matter 23 were only exposed to in situ liquids. Another example includes a pill that dissolves a soluble coating on the naturally occurring organic matter 23, such as a mildly acidic solution that is chosen for selectively dissolving the soluble coating while have a negligible effect on the component parts of the packer 10. In each of these examples, water is just one type of pill is pumped down hole because sufficient in situ water is unavailable at the depth at which the packer is set to ensure that the organic matter 23 increases in volume at a desirable rate. Yet another example is to pump a pill that selectively interacts with the naturally occurring organic matter 23; such pills are selected, among others, to harden the naturally occurring organic matter 23, dissolve the organic matter 23, and other similar interactions. For example, an acid pill dissolves or interacts with the organic matter 23 such that the volume of the organic matter 23 is reduced. As the volume of the organic material decreases, the volume of the enclosure 25 decreases under the hydrostatic pressure of the fluids present in the wellbore, which in turn releases the hydraulic seal between the impermeable membrane 22 and the well bore or casing surface, permitting the packer to be removed or retrieved from the well bore.

Although the foregoing description contains many specifics and examples, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein and which fall within the meaning of the claims are to be embraced within their scope.

What is claimed is:

1. An expandable downhole tool for hydraulically isolating a first section of a well bore from a second section of the well bore, the expandable downhole tool comprising:

a base pipe configured to connect to a means of conveying the expandable downhole tool to a selected depth in the well bore; and, an enclosure formed from a permeable membrane and an impermeable element, the impermeable element having a first side fixedly connected to the base pipe, the enclosure being sized and configured to hold a preselected volume of at least one naturally occurring organic material that increases from the preselected volume to a second volume as the naturally occurring organic material interacts with at least one of water or heat proximate the enclosure, the water or the heat communicating through the permeable membrane into the enclosure, the impermeable element effecting a hydraulic seal against the well bore as the naturally occurring organic matter increases in volume and urges the enclosure into contact with the well bore.

2. The expandable downhole tool of claim 1, wherein the naturally occurring organic material further comprises at least one of a plant, plant product, or plant derivative.

3. The expandable downhole tool of claim 2, wherein the naturally occurring organic material further comprises at least one of a grain or a legume.

4. The expandable downhole tool of claim 3, wherein the at least one of a grain or a legume is dehydrated prior to placing the grain or legume within the enclosure.

5. The expandable downhole tool of claim 1, wherein the at least one of a grain or a legume is heated prior to placing the grain or legume within the enclosure.

6. The expandable downhole tool of claim 1, wherein wherein the organic material has a soluble coating.

7. The expandable downhole tool of claim 1, wherein the naturally occurring organic material further comprises a matrix of a soluble substance and the naturally occurring organic matter held in the enclosure.

8. The expandable downhole tool of claim 1, further comprising a locking collar configured to fixedly connect the impermeable element to the base pipe.

9. The expandable downhole tool of claim 1, wherein the impermeable element and the permeable membrane are bonded together with at least one of a glue, a bonding agent, a heated seam, a stitched seam, an ultrasonic weld, and a radiofrequency weld.

10. The expandable downhole tool of claim 1, wherein the permeable membrane is formed contiguously from the impermeable material.

11. The expandable downhole tool of claim 1, wherein the permeable membrane further comprises a plurality of pores configured to pass at least one of the water or the heat present in the well bore into the enclosure.

12. The expandable downhole tool of claim 11, wherein the plurality of pores have a diameter that permits water present in the well bore to pass but prevents another liquid present in the well bore from passing into the enclosure.

13. The expandable downhole tool of claim 1, wherein a bonding agent fixedly connects the impermeable element to the base pipe.

14. The expandable downhole tool of claim 1, wherein the base pipe further comprises a conduit through which a fluid present in the second section of the well bore communicates with a means of conveying the fluid to the surface.

15. The expandable downhole tool of claim 1, wherein the well bore comprises one of a formation, casing, production tubing, or other pipe.

16. A method of manufacturing an expandable downhole tool for hydraulically isolating a first section of a well bore from a second section of the well bore, the method comprising:

forming an enclosure from an impermeable element and a permeable membrane, the enclosure being sized and configured to hold a preselected volume of naturally occurring organic material;

fixedly connecting a first side of the impermeable element to a base pipe, the base pipe configured to connect to a means of conveying the downhole tool to a selected depth in a well;

selecting a preselected volume of least one naturally occurring organic material that increases from the preselected volume to a second volume as the naturally occurring organic material interacts with at least one of water or heat proximate the enclosure; and, sealing the at least one of the naturally occurring organic material within the enclosure.

17. The method of manufacturing an expandable downhole tool of claim 16, wherein forming the enclosure further comprises bonding the impermeable element to the permeable membrane with at least one of a glue, a bonding agent, a heated seam, a stitched seam, an ultrasonic weld, and a radiofrequency weld.

18. The method of manufacturing an expandable downhole tool of claim 17, wherein fixedly connecting the impermeable element to a base pipe further comprises applying a bonding agent to at least one of the base pipe and the impermeable element.

19. The method of manufacturing an expandable downhole tool of claim 17, further comprising adding to the enclosure at least one of a chemical and a biological agent that causes the naturally occurring organic material to harden subsequent to conveying the downhole expandable tool into the well bore.

20. The method of manufacturing an expandable downhole tool of claim 16, wherein selecting the at least one naturally occurring organic material further comprises selecting at least one of a plant, a plant product, and a plant derivative.

21. The method of manufacturing an expandable downhole tool of claim 20, wherein selecting the at least one naturally occurring organic material further comprises selecting at least one of a grain and a legume.

22. The method of manufacturing an expandable downhole tool of claim 16, wherein selecting the naturally occurring organic material further comprises selecting naturally occurring organic material having at least one of a rate of expansion and a ratio of expansion that correlates with a characteristic of a given well bore.

23. The method of manufacturing an expandable downhole tool of claim 16, further comprising dehydrating the naturally occurring organic material prior to placing the naturally occurring organic material in the enclosure.

24. The method of manufacturing an expandable downhole tool of claim 16, further comprising applying a soluble coating to the naturally occurring organic material.

25. The method of manufacturing an expandable downhole tool of claim 16, further comprising forming a mixture of the naturally occurring organic material and a soluble component to delay an interaction between a fluid and the naturally occurring organic material.

26. The method of manufacturing an expandable downhole tool of claim 16, further comprising selecting a permeable membrane that includes a plurality of pores configured to pass at least one of the water or heat present in the well bore into the enclosure.

27. The method of manufacturing an expandable downhole tool of claim 26, wherein the selecting a permeable membrane further comprises selecting a permeable membrane that includes a plurality of pores having a diameter that permits water present in the well bore to pass but prevents another liquid present in the well bore from passing into the enclosure.

28. A method of using an expandable downhole tool to hydraulically isolate a first section of a well bore from a second section of the well bore, comprising:

conveying the expandable downhole tool to a selected depth in the well bore with a means of conveyance connected to a base pipe of the expandable downhole tool, the expandable downhole tool including an enclosure formed from an impermeable element and a permeable membrane, the enclosure being sized and configured to hold a preselected volume of at least one naturally occurring organic material that increases from a preselected volume to a second volume as the naturally occurring organic material interacts with at least one of water or heat;

exposing the preselected volume of naturally occurring organic material to the at least one of water or heat proximate the enclosure and communicated through the permeable membrane to interact with the naturally occurring organic material; and, effecting a hydraulic seal between the impermeable element and the well bore as the naturally occurring organic material increases in volume and urges the enclosure into contact with the well bore.

29. The method of using the expandable downhole tool of claim 28, wherein the well bore comprises one of a formation, casing, production tubing, or other pipe.

* * * * *